United States Patent [19]

Surko, Jr.

[11] 4,103,526

[45] Aug. 1, 1978

[54] PIN TUMBLER LOCK

[75] Inventor: Walter E. Surko, Jr., Southington, Conn.

[73] Assignee: Emhart Industries, Inc., Farmington, Conn.

[21] Appl. No.: 734,199

[22] Filed: Oct. 20, 1976

Related U.S. Application Data

[63] Continuation of Ser. No. 555,404, Mar. 5, 1975, abandoned.

[51] Int. Cl.[2] ..... E05B 15/14; E05B 27/04

[52] U.S. Cl. ..... 70/364 A; 70/378; 70/419

[58] Field of Search ..... 70/364 R, 364 A, 27 C, 70/37 B, 37 C, 419, 421

[56] References Cited

U.S. PATENT DOCUMENTS

| | | | |
|---|---|---|---|
| 1,230,387 | 6/1917 | Epstein | 70/378 |
| 3,287,945 | 11/1966 | Yulkowski | 70/364 A |
| 3,499,302 | 3/1970 | Spain | 70/364 A |

*Primary Examiner*—Robert L. Wolfe

*Attorney, Agent, or Firm*—McCormick, Paulding & Huber

[57] ABSTRACT

A pin tumbler lock cylinder having axially elongated split pin tumbler assemblies each including a pin tumbler and a driver releasably coupled in locked position to prevent rotation of a key plug relative to a supporting cylinder shell. Insertion of a proper angularly bitted key into the key plug causes the tumbler assemblies to axially translate and rotate within bores, defined by the shell and the plug in its locked position, to predetermined releasing positions wherein a split line of each tumbler assembly is aligned with a shear line between the plug and the shell and each pin tumbler is free to separate from its associated driver to permit rotation of the key plug to an unlocked position. Means are provided to prevent rotation of the drivers and tumblers relatively to the shell and plug respectively, when the plug is rotated to an unlocked position. In a master keyed lock cylinder drivers are coupled to pin tumblers by master pins.

35 Claims, 18 Drawing Figures

PIN TUMBLER LOCK

This is a continuation of application Ser. No. 555,404 filed Mar. 5, 1975 and now abandoned.

BACKGROUND OF THE INVENTION

This invention relates in general to pin tumbler locks and deals more particularly with improvements in locks of a type wherein pin tumblers reciprocally positioned by bits cut on one edge of a key release a plug for rotation relative to a supporting cylinder shell.

Heretofore, locks have been provided wherein pin tumblers carried by a key plug are positioned by a properly bitted key reciprocally to clear a shear line between the key plug and its supporting shell and also positioned rotationally to release another locking member so that it also clears the shear line. Typical lock cylinders of the aforedescribed general type are illustrated and described in U.S. Pat. Nos. 3,499,302 and 3,722,240 to Spain et al.; 3,449,303 to Spain; and 3,837,197 to Lopez. Each of the key operated lock cylinders disclosed in the aforesaid prior art references includes pin tumblers reciprocally positioned to clear a shear line and rotationally or angularly positioned to release another locking member which comprises a side bar or fence. While such locks provide a high degree of security and facilitate a large number of possible key changes, utilization of multiple locking elements; e.g. both pin tumblers and a side bar or fence, substantially increase the number of parts and operations required to make a lock, as compared to a lock of conventional pin tumbler type, which utilizes only one form of locking element.

Accordingly, it is the general aim of the present invention to provide improved pin tumbler locks having locking members consisting solely of pin tumbler assemblies, difficult if not impossible to pick, and which provide a significantly greater number of key change possibilities than pin tumbler locks heretofore available. A further aim of the invention is to provide improved pin tumbler locks which may be readily adapted for use in master keyed systems.

SUMMARY OF THE INVENTION

In accordance with the present invention, the combination comprising a lock and a properly bitted key is provided wherein the lock has a body or shell, a plug supported for rotation in the shell along a shear line between locked and unlocked positions, and at least one axially elongated split pin tumbler assembly supported in a bore defined by the shell and the plug in its locked position. The tumbler assembly includes a pin tumbler, a driver, and means for releasably coupling the driver to the pin tumbler for rotation therewith within the bore. When the lock is in a locked condition the tumbler assembly extends across the shear line to block rotation of the plug relative to the shell. The pin tumbler is shaped to cooperate with an associated bit on the key to raise, lower and rotate the pin tumbler assembly about its axis to a releasing position wherein a split line at least partially defined by the coupling means is aligned with the shear line to permit separation of the pin tumbler from the driver and rotation of the plug from its locked position to an unlocked position.

DETAILED DESCRIPTION OF PREFERRED EMBODIMENTS

Figure 1:
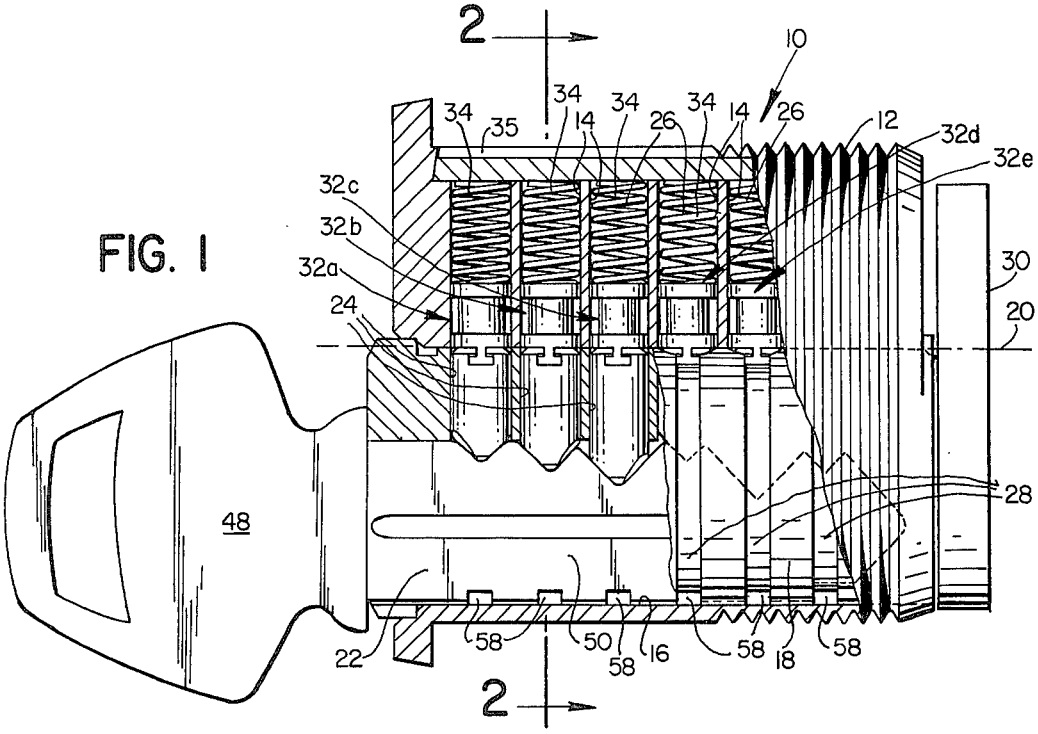
FIG. 1 is a side elevational view of a lock cylinder and key embodying the invention, portions of the cylinder shell and plug shown broken away and in longitudinal section.

Turning now to the drawings and referring first particularly to FIGS. 1–4, a lock cylinder embodying the present invention and indicated generally by the reference numeral 10 comprises a cylindrical shell 12 provided with an annular flange at its outer end and externally threaded for connection to a suitable supporting structure in which the lock cylinder is to be used. A plurality of cylindrical driver holes 14, 14 formed in the upper portion of the shell 12 communicate with a bore 16 which extends longitudinally through the lower portion of the shell 12.

Figure 2:
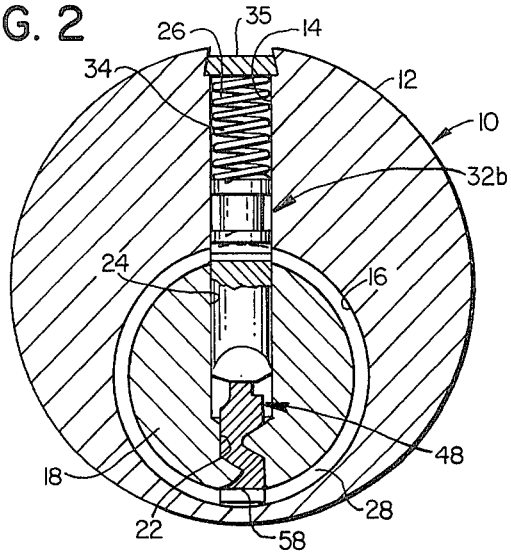
FIG. 2 is a sectional view taken along the line 2—2 of FIG. 1.

A generally cylindrical key plug 18 is supported for rotation in the bore 16 along a shear line 20 between locked and unlocked positions, as hereinafter further discussed. The key plug 18 has a keyway or key slot 22 formed in its lower portion which extends longitudinally therethrough and opens through its lower peripheral surface, as shown in FIGS. 1 and 2. A plurality of cylindrical tumbler holes 24, 24 equal in number to the driver holes 14, 14 and formed in the upper portion of the key plug 18 open into the key slot 22. When the key plug 18 is in its locked position, as it appears in FIGS. 1 and 2, each pin tumbler hole 24 is coaxially aligned with an associated driver hole 14 and cooperates therewith to define a generally vertically disposed bore 26 for receiving an associated pin tumbler assembly. The illustrated lock 10 has six pin tumbler bores 26, 26 five of which are shown in FIG. 1, and may be set up with as many as six pin tumbler assemblies. An axially spaced series of annular grooves 28, 28 open radially outwardly through the peripheral surface of the key plug. Preferably and as shown, each groove 28 has opposing side walls 29, 29 and a generally rectangular cross section. In the illustrated lock cylinder 10 each pin tumbler hole 24 opens into an associated groove 28, and it should be noted that the width of each groove 28 is substantially less than the diameter of the associated pin tumbler hole 24 which intersects it. At its inner end the key plug 18 carries a conventional cam 30 for operating an associated lock mechanism (not shown), for example, the bolt mechanism of an associated door lock.

Figure 3:
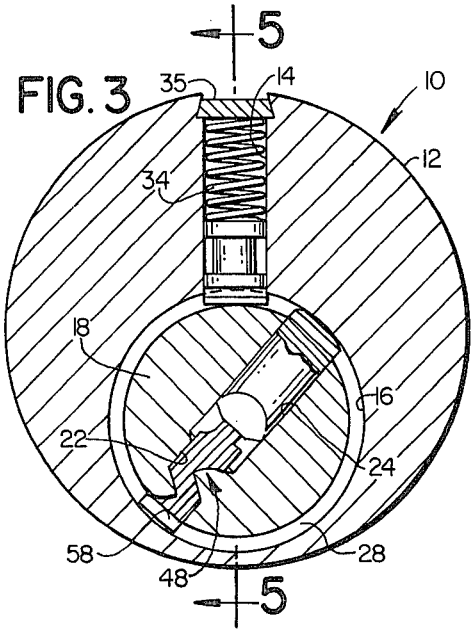
FIG. 3 is similar to FIG. 2, but shows the key plug rotated to an unlocked position.

In accordance with the present invention, a lock cylinder has at least one axially elongated tumbler assembly which comprises a plurality of elements and means for coupling the elements for rotation in unison within an associated bore defined by the shell and the key plug in its locked position. The coupling means at least partially defines a split line along which the elements may separate when the tumbler assembly is moved axially and rotated about its axis to a releasing position wherein the split line is aligned with the shear line between the plug and shell to release the plug for rotation relative to the shell and to an unlocked position. A lock cylinder in accordance with the invention may also have one or more split tumbler assemblies which include conventional pin tumblers and drivers separable along split lines, but not coupled for rotation in the manner aforedescribed. However, the illustrated lock cylinder 10 has six pin tumbler assemblies of coupled type, five of which are shown in FIG. 1 and respectively generally indicated at **32*a*–32*e*. Each pin tumbler assembly is received in an associated bore 26 and biased in the direction of the key plug 18 by an associated driver spring 34. A slide 35 received in a dove-tailed slot in the shell 12 retains the various tumbler assemblies 32*a*–32*e* and springs 34, 34 within respective bores 26, 26 as best shown in FIGS. 1–3**.

Figure 9:
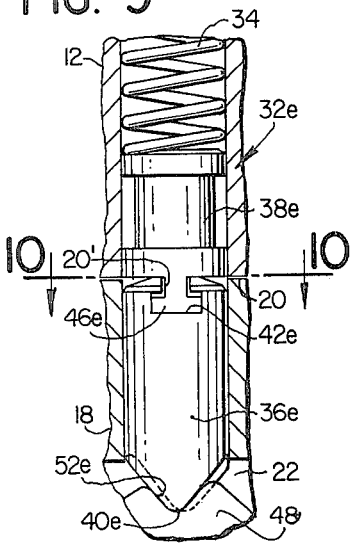
FIG. 9 is a somewhat enlarged fragmentary longitudinal sectional view of the lock cylinder of FIG. 1.
Figure 8:
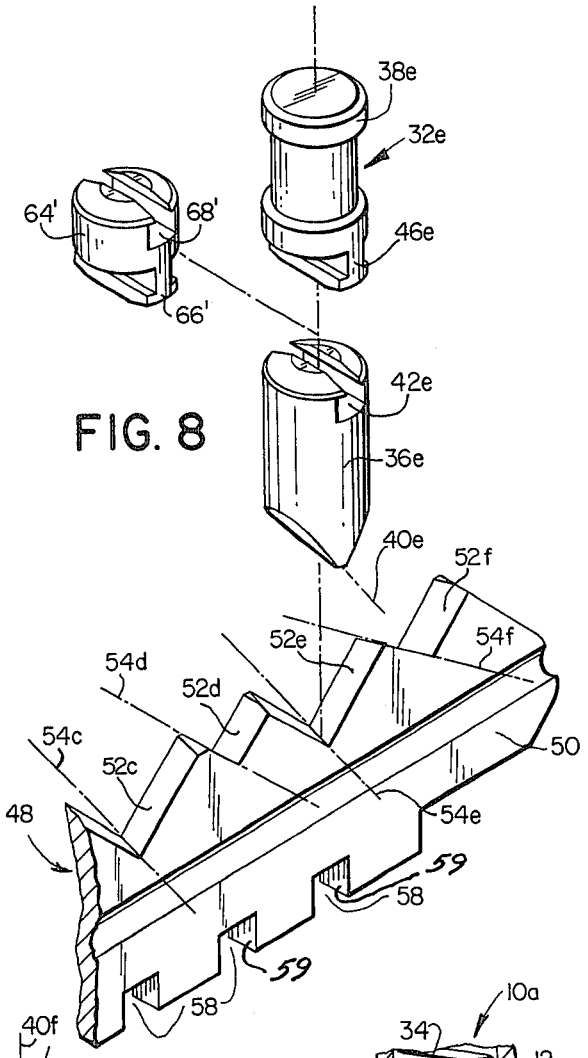
FIG. 8 is a somewhat enlarged exploded perspective view of a portion of a key and an associated pin tumbler assembly and also shows a master pin which may comprise a part of the tumbler assembly.
Figure 10:
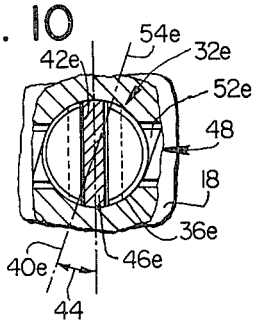
FIG. 10 is a fragmentary sectional view taken along the line 10—10 of FIG. 9, a portion of the key plug shown broken away to reveal the key therein.

The pin tumbler assemblies will now be described in further detail with particular reference to a typical pin tumbler assembly **32*e*, best shown in FIGS. 8–10. The tumbler assembly 32*e* includes a pin tumbler 36*e* carried by the key plug 18 and a driver 38*e* disposed within the shell 12 and releasably coupled to the pin tumbler. The pin tumbler 36*e* comprises an axially elongated cylindrical pin which has a key engaging lower end portion shaped to cause axial translation and axial rotation of the tumbler assembly to predetermined axial and angular positions relative to the key plug 18 and the shell 12 in response to engagement with an associated bit on a properly bitted key. More specifically, the pin tumbler 36*e* has a generally V-shaped chisel tip at its lower end defined by two planes which intersect generally at an apex 40*e*. The line of intersection formed by the planes and which defines the apex 40*e* intersects and is generally normal to the axis of the pin tumbler 36*e*. Preferably and as shown the chisel tip is slightly rounded at its apex 40*e* to smoothly engage key bits. At its upper end the pin tumbler 36*e* has an axially transverse T-slot 42*e* which preferably extends diametrically thereacross and which is or may be angularly offset relative to the chisel tip of the pin tumbler. In accordance with the presently preferred lock cylinder construction pin tumblers of three general types are employed which provide three basic T-slot arrangements. One type, referred to as a neutral tumbler, has its T-slot in parallel alignment with the apex of its chisel tip. A pin tumbler may also be provided which has the longitudinal axis of its slot angularly offset 20° in either direction about its axis and relative to its chisel tip. The length of the pin tumblers vary in accordance with a selected code, as well known to those skilled in the art. The illustrated pin tumbler 36*e* has a 20° negative offset, that is the longitudinal axis of its slot 42*e* is angularly offset 20° in a counterclockwise direction about its axis from the line of the apex designated 40*e*, as viewed from above and as shown in FIG. 10, the offset angle being indicated by the numeral 44. However, other pin tumblers which comprise the lock 10** have positive angular offsets, the slots thereof being angularly offset in a clockwise direction, as will be hereinafter discussed.

The driver **38*e* comprises a generally cylindrical spool-shaped member and has a coupling projection 46*e* on its lower end which has a generally T-shaped cross-section. The width of the projection 46*e* is substantially equal to the width of the annular groove 28 with which it is associated. The projection is adapted to be received in and generally complement the T-slot 42*e* and cooperates with the slot to couple the driver 38*e* to the tumbler 36*e* for axial rotation therewith. The projection and the slot also cooperate to prevent the driver and the tumbler from separating in generally axially opposite directions. The projection 46*e* and its associated slot 42*e* define a generally T-shaped split line 20′ (FIG. 9) normal to the longitudinal axis of the slot and along which the pin tumbler 36*e* and driver 38*e* may separate, but only when the pin tumbler is moved relative to the driver in a unique axial plane defined by the axis of the pin tumbler assembly 32*e* and the longitudinal axis of the slot 42*e*. Thus the pin tumbler 36*e* and the driver 38*e* may separate when the latter unique axial plane is disposed in a unique radial plane of the key plug 18, as it appears in FIG. 9, and the pin tumbler is moved in a transverse direction relative to its axis such as will occur upon rotation of the key plug 18 relative to the shell 12. However, before such separation can occur the split line 20′ must be aligned with the shear line 20**, as will be hereinafter further discussed.

The key for operating the lock cylinder 10, hereinbefore described, is indicated generally at 48 and includes an elongated blade 50 which has a plurality of generally V-shaped bits **52*a*–52*f* cut to various depths along its upper edge in accordance with a selected code which matches the code of the tumblers which it is to operate. The bits 52*a*–52*f* are cut across the key blade 50, each bit being generally defined by two planes which form an included angle of 90° and intersect along a line of intersection which lies in a plane generally normal to the blade 50, the lines of intersection of the various bits being indicated at 54*a*–54*f*. Preferably, at least one of the bits is cut skew relative to the longitudinal axis of the key blade 50**, so that the line of intersection of said one bit form an acute angle with one side of the key blade, but, if desired, all of the bits may be skew cut.

Figure 11:
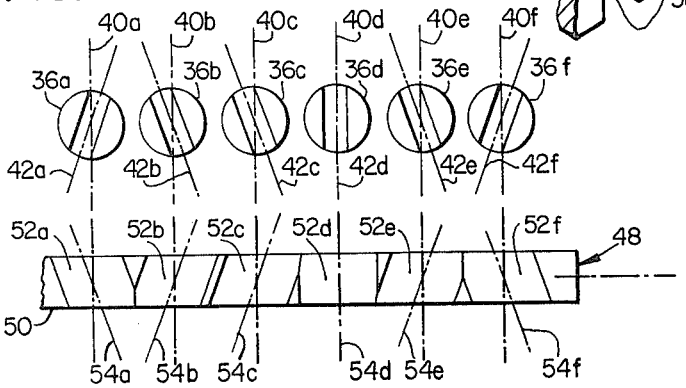
FIG. 11 is a diagramatic view of the pin tumblers and key of the lock cylinder of FIG. 1.

Referring now to FIG. 11, a proper key 48 for unlocking the lock cylinder 10 is diagramatically illustrated with reference to the pin tumblers **36*a*–36*f* which it operates. The tumbler 36*d* comprises a neutral tumbler, the axis of its slot 42*d* being parallel to the apex of its chisel tip. Accordingly, the corresponding key bit 56*d*, which operates the tumbler 36*d*, comprises a neutral bit cut perpendicular to the longitudinal axis of the blade 50. The pin tumblers 36***a* and 36*f* each have a 20° positive angular offset, therefore, the corresponding bits 52*a* and 52*f* which operate the latter pin tumblers are cut with a 20° negative offset. Thus, for example, the line of intersection 54*a* of the V-shaped bit 52*a*, is angularly offset 20° in a counterclockwise direction from a neutral axis normal to the longitudinal axis of the blade 50, as viewed from above in FIG. 11. The remaining pin tumblers 36*b*, 36*c* and 36*e* each have a 20° negative offset, hence, the corresponding key bits 52*b*, 52*c* and 56*e* which operate these pin tumblers have 20° positive offsets. The key 48 also has a plurality of notches 58, 58 formed in its lower edge and cut generally perpendicular to the axis of the blade 50. Preferably and as shown, each notch 58 has opposing inner walls 59, 59 and a generally rectangular cross-section and is adapted to complement and at least partially define a portion of an associated one of the grooves 28, 28 when the key 48 is fully inserted into the key slot 22, as best shown in FIG. 1.

Figure 4:
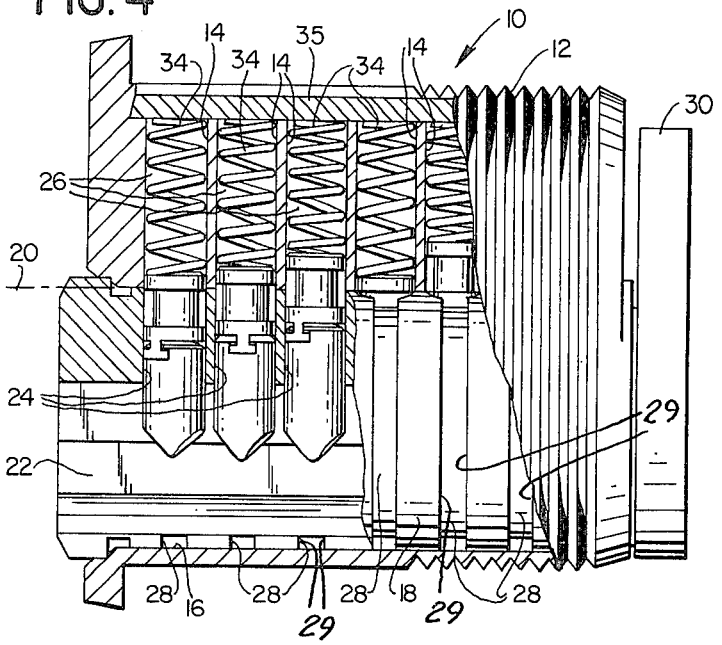
FIG. 4 is similar to FIG. 1, but shows the lock cylinder with the key removed therefrom.
Figure 5:
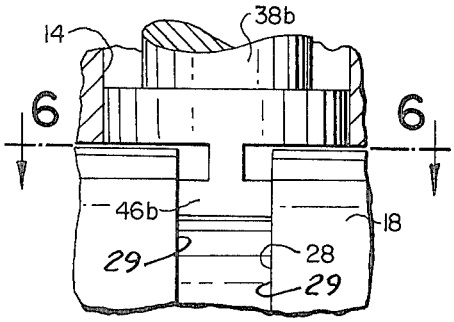
FIG. 5 is a somewhat enlarged fragmentary sectional view taken along the line 5—5 of FIG. 3.
Figure 6:
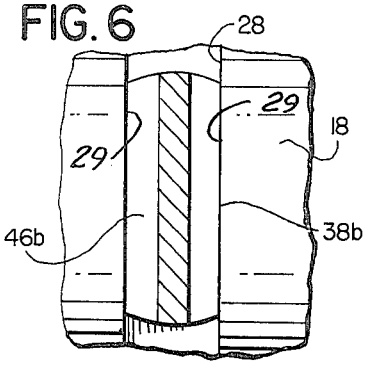
FIG. 6 is a fragmentary sectional view taken along the line 6—6 of FIG. 5.
Figure 7:
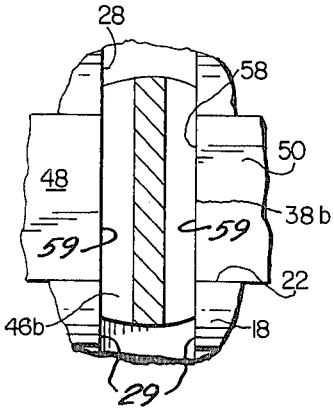
FIG. 7 is similar to FIG. 6, but shows the position of the key plug and key relative to a driver after rotation 180 degrees from the locked position of FIG. 2.

Considering now the operation of the lock cylinder 10, when the lock cylinder is in its locked condition with the key removed therefrom, as its appears in FIG. 4, the key plug 18 is in its locked position and the tumbler assemblies 32*a*–32*f* extend across the shear line 20 to prevent rotation of the key plug 18 relative to the shell 12. The tumbler assemblies are or may be disposed in random angular positions within the bores 26, 26. When the proper key 48 is fully inserted into the key slot 22 the various tumbler assemblies are raised and lowered or axially translated and rotated to predetermined release positions wherein the split lines 20', 20' between the pin tumblers and drivers are generally aligned with the shear line 20 and the longitudinal axes of the slots 42*a*–42*f* are generally disposed in radial planes relative to the plug 18. The lock cylinder 10 is then in an unlocked condition, as it appears in FIGS. 1 and 2, from which position the key 48 may be rotated in either direction to rotate the key plug 18 and thereby separate each of the pin tumblers 36*a*–36*f* from its respective driver. As the key plug 18 is rotated to an unlocked position, such as its position of FIG. 3, each of the T-shaped coupling projections 46*a*–46*e* on the drivers 38*a*–38*e* enters its associated annular groove 28. The side walls of each groove cooperate with an associated coupling projection to prevent the driver associated therewith from rotating about its axis within its driver hole 14 while the key plug 18 is in an unlocked position, as illustrated in FIGS. 5–7, where a typical driver 38*b* is shown. When the key 48 is fully inserted into the key plug 18 the notches 58, 58 substantially complement and at least partially define the grooves 28, 28. More specifically, the side walls of each notch 58 are substantially aligned with the side walls of an associated groove, as shown in FIG. 7 wherein the position of a typical coupling projection 46*b* is shown relative to the key plug 18 and key 48, which have been rotated 180° from the locked position of FIG. 2, so that each notch provides means for preventing angular movement of an associated driver. Thus the key 48 may travel smoothly past the projections 46*a*–46*e* when the plug 18 is rotated more than one half revolution from its locked position relative to the shell 12. The pin tumblers 36*a*–36*f* are restrained against rotation within the tumbler holes 24, 24 by the cooperation of the key 48 and the bore 16 while the key plug 18 is in an unlocked position. Thus, the coupling projections on the drivers and the coupling slots in the pin tumblers cannot become misaligned when the lock cylinder 10 is in an unlocked condition.

Rotation of the key and key plug from an unlocked position to the locked position (FIG. 2) moves the pin tumblers into coupled engagement with the drivers. The key may be withdrawn from the lock cylinder 10 when the key plug is in its locked position. Withdrawal of the key tends to cause random rotation of the various tumbler assemblies which scrambles the tumbler assemblies leaving them in random angular positions relative to the key plug and shell.

Figure 12:
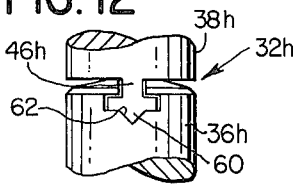
FIG. 12 is a fragmentary side elevational view of another pin tumbler assembly.

Sufficient clearance must be provided between the coupling projection on each driver and its associated tumbler slot to assure smooth coupling engagement and disengagement of the pin tumblers and drivers when the key plug is rotated between locked and unlocked positions. Clearance or tolerance requirements will, of course, be determined at least to some degree by the shape of the coupling employed. However, it is essential that each pin tumbler be connected with its associated driver in coupled condition so that the pin tumbler will accurately rotate the driver to its release position when a proper key is inserted in the lock cylinder. Referring now particularly to FIG. 12 another embodiment of the invention is illustrated with reference to a tumbler assembly indicated generally at 32*h* which includes a tumbler 36*h* and a driver 38*h* constructed and arranged to assure substantially play-free angular drive connection therebetween. The pin tumbler 36*h* has a T-shaped slot in its upper end for receiving a T-shaped coupling projection 46*h* which depends from the driver 38*h*. The coupling projection 46*h* is loosely received in the slot, sufficient clearance being provided to assure smooth coupling engagement and disengagement. However, the projection 46*h* is provided with a protrusion 60 which has a V-shaped cross section and which is received in and closely complements an upwardly opening V-shaped recess or groove 62 in the upper end of the tumbler 36*h*. The protrusion 60, urged into the complementary groove 62 by an associated driver spring, provides positive drive connection between the tumbler 32*h* and its associated driver 38*h*, substantially free of angular play, so that the driver 38*h* is accurately rotated to its releasing position by the tumbler 36*h* in response to the action of a proper key.

Figure 13:
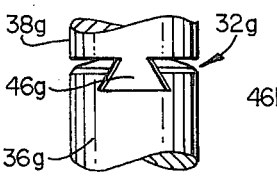
FIG. 13 is similar to FIG. 12, but shows a further pin tumbler assembly.

Various other coupling arrangements may be provided for releasably securing each tumbler in coupled relation with an associated driver. In FIG. 13 a further embodiment of the invention is illustrated with reference to a tumbler assembly 32*g* wherein a driver 38*g* is provided with a dove-tailed coupling projection 46*g* which cooperates with an associated dove-tailed slot formed in a tumbler 36*g*.

Conventional techniques for picking pin tumbler lock cylinders rely upon separation occurring between drivers and tumblers. Since the coupled tumbler assemblies of the aforedescribed embodiments are positively mechanically coupled to resist separation in axially opposite directions it will be apparent that the aforedescribed lock cylinders cannot be picked by such conventional methods.

Figure 14:
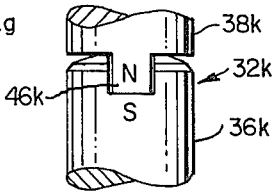
FIG. 14 is also similar to FIG. 12, but shows still another pin tumbler assembly.

Referring now to FIG. 14, a still further embodiment of the invention is illustrated with reference to a tumbler assembly 32*k* which includes a pin tumbler 36*k* and a driver 38*k*. The driver has a coupling projection 46*k* which has a rectangular cross section and is received in an associated generally complementary upwardly opening slot in the upper end of the tumbler 36*k*. The projection 46k and its associated slot provide a positive drive connection to assure rotation of the driver 38k about its axis in response to rotation of the tumbler 36k. An associated driver spring (not shown) continually urges the driver 38k toward coupled relation with the tumbler 36k. However, if desired, additional means may be provided for coupling the driver and tumbler to resist separation in axially opposite directions. The illustrated tumbler assembly 32k has magnetic means for coupling the driver 38k and the pin tumbler 36k. The tumbler and driver may comprise magnets arranged with opposite poles in coupled engagement, substantially as shown, or alternatively one of the elements may comprise a magnet and the other be made from a magnetic material.

A lock cylinder in accordance with the present invention may also be readily adapted for use in a master keyed locking system. A modified form of the lock cylinder 10 adapted for master key operation is illustrated in FIGS. 15–18 and indicated at 10a. The lock cylinder 10a includes a pin tumbler 36e and a driver 38e substantially identical to the correspondingly numbered parts previously described, however, it will be noted that a master pin 64 interposed between the pin tumbler and driver provides the coupling therebetween. The master pin 64 comprises a generally cylindrical pin which has a T-shaped coupling projection 66 on its lower end received in a complementary coupling slot in the pin tumbler 36e. At its upper end the master pin has a T-shaped coupling slot 68 which receives the coupling projection on the driver 38e. The coupling slot 68 is or may be angularly offset from the coupling projection 66. In accordance with the presently preferred master key coding system, three general types of master pins are provided. The illustrated master pin 64 is of a type which has a 40° positive angular offset, the longitudinal axis of its slot 68 being offset 40° in a clockwise direction relative to the axis of its coupling projection 66, as best shown in FIG. 16. In accordance with the presently preferred master keyed system, other master pins may be provided which have 40° negative offsets and still other master pins may be utilized which are of a neutral type. In FIG. 8, a typical neutral master pin is illustrated and indicated at 64', and it will be noted that the longitudinal axis of the slot 68' is substantially parallel to the longitudinal axis of the coupling projection 66'.

Figure 15:
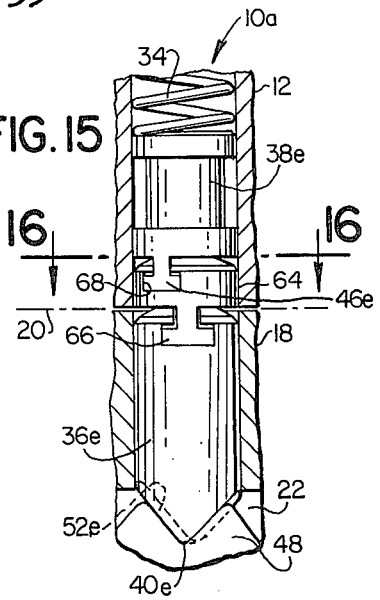
FIG. 15 is a fragmentary longitudinal sectional view of the lock cylinder of FIG. 1 modified for master key operation.
Figure 16:
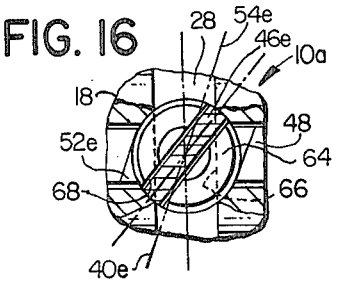
FIG. 16 is a sectional view taken along the line 16—16 of FIG. 15.

Considering now the operation of the master-keyed lock cylinder 10a, and further referring to FIGS. 15–18, in FIG. 15 the pin tumbler 36e is shown in its releasing position in engagement with the bit 52e of the key 48, which may comprise a change key in the aforesaid master keying system. The pin tumbler 36e has been rotated by the bit 52e to the position shown in FIG. 10, previously described. The latter bit has a 20° positive offset angle 44, as shown in FIG. 10. When the tumbler 32e is in its releasing position (FIG. 15) it is free to separate from the master pin 64 and the driver 38e which remain within the cylinder shell 12 when the plug 18 is rotated to an unlocked position.

Figure 17:
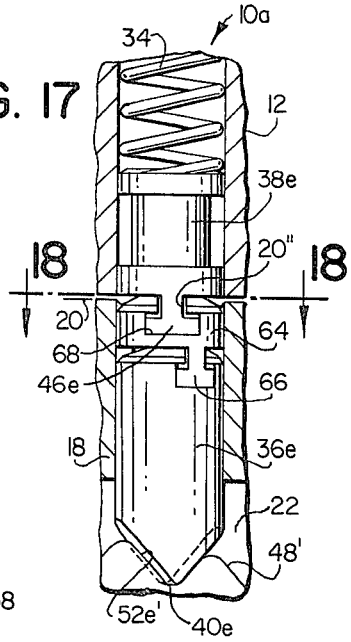
FIG. 17 is similar to FIG. 15, but shows the key plug with a master key therein.
Figure 18:
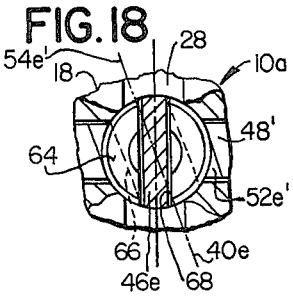
FIG. 18 is a fragmentary sectional view taken along the line 18—18 of FIG. 17.

A master key for operating the lock cylinder 10a is shown in FIG. 17 and indicated generally at 48'. The master key 48' has a bit 52e' which is cut to a depth greater than the depth of the bit 52e by an amount equal to the effective axial length of the master pin 64. The angle of the bit 52e' is determined by the relative angular relationship between the chisel tip apex 40e and the slot 68 when the master pin 64 is coupled to the pin tumbler 36e. In the illustrated case, FIGS. 17 and 18, the slot 68 has a 20° positive offset relative to the apex 40e. Accordingly, the master key 48' for operating this coupled pin tumbler-master pin must have a 20° negative offset. Thus, when the key 48' is inserted into the lock cylinder 10a the bit 52e' causes axial translation and rotation of the master pin to its releasing position as shown in FIGS. 17 and 18. In the latter position the split line 20'' defined by the coupling between the master pin 64 and the driver 38e is aligned with the shear line 20. The master pin 64 which is disposed within the key plug 18 and coupled to the pin tumbler 36e is then free to separate from the driver 38e along the split line 20'' in response to rotation of the plug to an unlocked position.

Since various master pins may be coupled to various pin tumblers, it will now be apparent that the angular bitting selected for use on a master key is independent of the angular bitting on the change key. Thus, the angular bitting required to make a master key for opening a series of locks embodying the invention cannot be predicted by examination of a proper change key which opens one or more locks in the series.

The invention has been illustrated and described with reference to lock cylinders, however, it should be understood that the present invention may be embodied in locks of other types, for example, padlocks, and such embodiments are contemplated within the scope of the invention.

I claim:

1. In a pin tumbler lock having a shell, a plug rotatable relative to said shell along a shear line between locked and unlocked positions, said shell and said plug having holes therein coaxially aligned in said locked position to define a plurality of bores, a plurality of axially elongated tumbler assemblies respectively received in said bores, each of said tumbler assemblies having at least one split line, means normally biasing each of said tumbler assemblies in an axial direction to a position relative to said shell and said plug wherein a split line thereof is out of alignment with said shear line to prevent rotation of said plug from its locked position, and means defining a keyway in said lock for receiving a proper key to move each of said tumbler assemblies axially in opposition to its biasing means and to a position wherein a split line thereof is generally aligned with said shear line to permit said plug to be rotated from its locked position to an unlocked position, the improvement comprising at least one of said tumbler assemblies supported in an associated one of said bores for angular movement about its axis within said one bore, said one tumbler assembly including a pin tumbler, a driver, and means releasably coupling said driver to said pin tumbler for angular movement of said driver about its axis in response to angular movement of said pin tumbler about its axis within said one bore, said coupling means at least partially defining an associated split line along which said pin tumbler and said driver may separate when said one tumbler assembly is axially and angularly positioned relative to said plug and said shell in a predetermined releasing position wherein said associated split line is aligned with said shear line, means on said pin tumbler for positioning said one pin tumbler assembly in said predetermined releasing position in response to insertion of a proper key into said keyway, and a groove in said plug receiving an associated portion of said coupling means therein for preventing angular movement of said driver about its axis when said driver and said pin tumbler are separated by rotation of said plug from its locked position to an unlocked position.

2. The combination as set forth in claim 1 wherein said groove comprises an annular groove.

3. The combination as set forth in claim 1 wherein said coupling means comprises a projection on one of the members comprising said driver and said pin tumbler and a slot in the other of said members receiving said projection therein.

4. The combination as set forth in claim 3 wherein said slot is formed in an associated end of said other member and extends transversely of the axis thereof and said projection generally complements an associated portion of said slot.

5. The combination as set forth in claim 4 wherein said driver comprises said one member and said pin tumbler comprises said other member.

6. The combination as set forth in claim 3 wherein said projection is loosely received in said slot and said coupling means includes means releasably connecting said one member and said other member for substantially play-free angular drive connection therebetween.

7. The combination as set forth in claim 6 wherein said connecting means comprises a protrusion on one of said members received in and generally complementing a recess in the other of said members.

8. The combination as set forth in claim 7 wherein said driver comprises said one member and said protrusion is formed on one end thereof and said pin tumbler comprises said other member and said recess is formed in an associated end thereof.

9. The combination as set forth in claim 1 wherein said coupling means comprises means for releasably coupling said driver to said pin tumbler to resist separation therebetween in axially opposite directions.

10. The combination as set forth in claim 9 wherein said coupling means comprises a transverse slot in one end of one of said members comprising said driver and said pin tumbler and a projection on an associated end of the other of said members received in said slot.

11. The combination as set forth in claim 10 wherein said slot and said projection are shaped for interlocking engagement.

12. The combination as set forth in claim 11 wherein said slot comprises a T-slot.

13. The combination as set forth in claim 11 wherein said slot comprises a dove-tailed slot.

14. The combination as set forth in claim 9 wherein said coupling means comprises magnetic means.

15. The combination as set forth in claim 1 wherein said coupling means comprises a master pin.

16. The combination as set forth in claim 15 wherein said master pin is releasably coupled to said driver to separate therefrom along one associated split line in one predetermined releasing position and releasably coupled to said pin tumbler to separate therefrom along another associated split line in another predetermined releasing position.

17. The combination as set forth in claim 16 wherein said one associated split line is angularly offset from said other associated split line.

18. A lock for operation by a properly bitted key comprising a shell, a plug supported for rotation in said shell between locked and unlocked positions, said plug and said shell having a shear line therebetween and holes therein coaxially aligned in said locked position to define a bore, means defining a keyway in said lock in communication with said bore, an axially elongated tumbler assembly coaxially supported in said bore for axial translation and axial rotation therein, said tumbler assembly including a plurality of tumbler elements and means releasably coupling said elements for axial rotation in unison within said bore, said coupling means defining at least one split line along which one of said elements may separate from another of said elements when said tubular assembly is in a predetermined axial and angular releasing position relative to said plug and said shell wherein said split line is aligned with said shear line, means normally biasing said tumbler assembly to a blocking position relative to said plug and said shell wherein said split line is out of alignment with said shear line to prevent rotation of said plug from its locked position, bit engaging means on said one element for moving said tumbler assembly to said releasing position in response to insertion of a proper key into said keyway to permit rotation of said plug from its locked position to an unlocked position, and a groove in one of the members comprising said plug and said shell receiving an associated portion of said coupling means when said plug is rotated from its locked position for maintaining said other element in its releasing position while said one element is separated from said other element.

19. A lock as set forth in claim 18 wherein said bit engaging means comprises a generally V-shaped chisel tip on said one element.

20. A lock as set forth in claim 18 wherein said coupling means comprises a projection on an end of one of said elements and a slot in an end of an associated other of said elements receiving said projection therein.

21. An axially elongated pin tumbler assembly comprising a plurality of generally cylindrical tumbler elements, and means releasably coupling said elements in coaxial end-to-end relation for axially rotating said elements in unison in response to rotation of one of the elements about its axis, said coupling means at least partially defining at least one split line along which said elements may separate when at least one of said elements is moved relative to another of said elements and in a direction lying in a unique axial plane, said tumbler assembly having a generally V-shaped chisel tip at one end thereof generally formed by two planes defining a line of intersection at the apex of said tip, said line of intersection lying outside of and oriented in a predetermined angular position relative to said unique axial plane for cooperative engagement with a generally complementary bit on an associated key inserted into a lock and controlling the extent of axial translation and axial rotation of said pin tumbler assembly in the lock, said coupling means including a non-cylindrical portion for complementing a groove in an associated part of the lock to prevent axial rotation of said associated element about its axis in the lock.

22. An axially elongated tumbler assembly as set forth in claim 21 wherein one of said elements comprises a driver, another of said elements comprises a pin tumbler, and said coupling means comprises a master pin disposed between said driver and said pin tumbler.

23. An axially elongated tumbler assembly as set forth in claim 22 wherein said coupling means includes means for releasably coupling said driver to said master pin along one split line and means for releasably coupling said pin tumbler to said master pin along another split line.

24. An axially elongated pin tumbler assembly as set forth in claim 21 wherein said coupling means comprises a projection on an end of one of said elements and a slot in the end of another of said elements receiving said projection therein.

25. The combination as set forth in claim 18 wherein said one member comprises said plug, said other element is carried by said plug, and said associated portion of said coupling means comprises a portion of said other element.

26. The combination comprising a lock and a key therefor, said lock having a shell, a key plug, means supporting said key plug for rotation in said shell generally along a shear line between locked and unlocked positions, said key plug having a key slot and a groove therein, said groove partially defined by opposing side walls and opening through the peripheral surface of said plug, said shell and said plug having holes therein coaxially aligned and defining at least one bore when said plug is in said locked position, said one bore communicating with said key slot and said groove, and an axially elongated split tumbler assembly supported for movement in an axial direction and for angular movement about its axis in said one bore and comprising a pin tumbler, a driver, and coupling means releasably connecting said driver to said pin tumbler for moving said driver angularly about its axis within said one bore in response to angular movement of said pin tumbler about its axis, said coupling means at least partially defining a split line along which said pin tumbler may separate from said driver when said tumbler assembly is axially and angularly positioned relative to said plug and said shell in a predetermined releasing position wherein said split line is aligned with said shear line, said side walls receiving an associated portion of said driver therebetween and cooperating therewith for restraining said driver against angular movement relative to said shell when said pin tumbler is separated from said driver, said key having bit means engageable with said pin tumbler for positioning said pin tumbler assembly in its releasing position in response to insertion of said key into said key slot, said key having a notch including inner walls aligned with said side walls and defining a continuation of said groove when said key is in said key slot.

27. An axially elongated pin tumbler assembly comprising a plurality of generally cylindrical tumbler elements and means releasably coupling said elements in end-to-end relation for axial rotation in unison in response to rotation of one of said elements about its axis, said elements including a driver and a pin tumbler, said coupling means comprising a master pin disposed between said driver and said pin tumbler and including means for releasably coupling said driver to said master pin to separate along one split line in response to relative movement therebetween and in a direction generally normal to said one split line, said coupling means further including means for releasably coupling said pin tumbler to said master pin to separate along another split line angularly offset from said one split line in response to relative movement therebetween and in a direction generally normal to said other split line, said tumbler assembly having a V-shaped chisel tip at one end thereof oriented in a predetermined angular position relative to one of the split lines comprising said one and said other split lines.

28. In a pin tumbler lock having a shell, a plug rotatable relative to said shell along a shear line between locked and unlocked positions, said shell and said plug having holes therein coaxially aligned in said locked position to define a plurality of bores, a plurality of axially elongated tumbler assemblies respectively received in said bores, each of said tumbler assemblies having at least one split line, means normally biasing each of said tumbler assemblies to a position relative to said shell and said plug wherein a split line thereof is out of alignment with said shear line to prevent rotation of said plug from its locked position, and means defining a keyway in said lock for receiving a proper key to move each of said tumbler assemblies axially in opposition to its biasing means and to a position wherein a split line thereof is generally aligned with said shear line to permit said plug to be rotated from its locked position to an unlocked position, the improvement comprising at least one of said tumbler assemblies including a pin tumbler, a driver, and a master pin releasably coupling said driver to said pin tumbler for angular movement about its axis in response to angular movement of said pin tumbler about its axis and within an associated bore, said master pin being releasably coupled to said driver to separate therefrom along one associated split line in one predetermined releasing position wherein said one associated split line is aligned with said shear line, said master pin being releasably coupled to said pin tumbler to separate therefrom along another associated split line in another predetermined releasing position wherein said other associated split line is aligned with said shear line, said one associated split line being angularly offset from said other associated split line, and means on said pin tumbler for cooperating with a proper key to position said one pin tumbler assembly in an associated predetermined releasing position in response to insertion of the proper key into said keyway whereby to permit said plug to be rotated from its locked to an unlocked position.

29. A lock comprising a shell member, a plug member supported for movement in said shell member between locked and unlocked positions, the members having a shear line therebetween and holes therein coaxially aligned to define a bore when said plug member is in its locked position relative to the shell member, means defining a keyway in one of said members, an axially elongated tumbler assembly coaxially supported in said bore for axial translation and angular movement about its axis within said bore and relative to said plug and shell members, said tumbler assembly including a plurality of tumbler elements and means releasably coupling said tumbler elements for angular movement in unison within said bore, said coupling means defining at least one split line along which one of said elements may separate from another of said elements only when said one element is moved relative to said other element in a direction lying within a unique axial plane of said tumbler assembly, means on said tumbler assembly engageable with a proper key inserted in said keyway for axially translating and angularly positioning said tumbler assembly in a releasing position wherein said split line is aligned with said shear line and said unique axial plane of said tumbler assembly is disposed in a unique plane of said plug to permit said plug to be moved from its locked to an unlocked position, and a groove in one of said members receiving an associated portion of said coupling means therein for preventing angular movement of said other element about its axis while said one element is separated therefrom.

30. The combination comprising a lock and a key therefor, said lock having a shell, a key plug supported for rotation in said shell generally along a shear line between locked and unlocked positions, said key plug having a key slot opening through its peripheral surface and a groove therein having a pair of opposing side walls, said shell and said plug having holes therein coaxially aligned in said locked position to define at least one bore communicating with said key slot, and an axially elongated cylindrical split tumbler assembly received in said one bore and comprising a pin tumbler, a driver, and means releasably coupling said pin tumbler and said driver for generally coaxial rotation in unison within said bore in response to rotation of said pin tumbler, said coupling means having a non-cylindrical portion and at least partially defining a split line along which said pin tumbler may separate from said driver when said tumbler assembly is axially translated and axially rotated to a predetermined releasing position wherein said split line is aligned with said shear line, said sidewalls receiving said non-cylindrical portion therebetween when said key plug is rotated from its locked to an unlocked position and preventing rotation of said driver relative to said shell when said pin tumbler is separated from said driver, means comprising coengaging surfaces on said key and said pin tumbler for axially translating and axially rotating said pin tumbler assembly to its releasing position in response to insertion of said key into said key slot, said key having a notch formed in an edge thereof and having opposing inner walls respectively aligned with said side walls and forming a continuation of said groove when said key is inserted into said key slot to engage said pin tumbler.

31. The combination as set forth in claim 30 wherein said key has an elongated blade and said coengaging surface on said key comprises a bit cut skew relative to the longitudinal axis of said blade.

32. The combination as set forth in claim 31 wherein said bit comprises a V-shaped bit defined by planes intersecting along a line of intersection which forms an acute angle with a side of said blade.

33. The combination as set forth in claim 32 wherein said notch is generally rectangular.

34. The combination comprising a lock and a key, said lock having a shell, a plug supported for rotation in said shell along a shear line between locked and unlocked positions, said plug having a keyway therein for receiving said key and a groove opening radially outwardly through its peripheral surface, said plug and said shell having holes therein coaxially aligned in locked position to define a bore intersecting said groove and communicating with said keyway, and an axially elongated cylin cal tumbler assembly coaxially supported in said bore and including a pin tumbler carried by said plug and a driver carried by said shell, said pin tumbler having a generally V-shaped chisel tip at one end exposed within said keyway and formed by intersecting surfaces of said tumbler defining a line of intersection at the apex of said tip, said line of intersection intersecting the axis of said tumbler, said pin tumbler having a slot opening through its opposite end and extending diametrically thereacross, said slot being angularly offset about the axis of said pin tumbler relative to said line of intersection, said driver having a projection on an end thereof adjacent said opposite end of said pin tumbler and received in said slot, said projection coupling said driver to said pin tumbler when said plug is in locked position, said key having means comprising a V-shaped bit engageable with said chisel tip for positioning said pin tumbler axially and angularly within said bore to align said slot with said groove, said groove receiving said projection when said plug is rotated from its locked position.

35. An axially elongated pin tumbler assembly comprising a plurality of cylindrical tumbler elements coupled together in coaxial end-to-end relation, one of said elements having a V-shaped chisel tip at one end thereof formed by surfaces inclined to the axis of said tumbler assembly and defining a line of intersection at the apex of said chisel tip, said line of intersection passing through the axis of said tumbler assembly, said one element having a slot in its other end extending transversely therethrough, the central axis of said slot extending diametrically of said other end and angularly offset relative to said line of intersection, said slot having a pair of opposing side walls, another of said elements having a non-cylindrical projection on one end thereof received within and generally complementing an associated portion of said slot and coupling said other element to said one element.

* * * * *

UNITED STATES PATENT OFFICE

CERTIFICATE OF CORRECTION

Patent No. 4,103526 Dated August 1, 1978

Inventor(s) Walter E. Surko, Jr.

It is certified that error appears in the above-identified patent and that said Letters Patent are hereby corrected as shown below:

Abstract, line 15, insert --,-- after "plug".

Column 8, line 8, "20"" should be --20'--.

Column 8, line 12, "20"" should be --20'--.

Column 9, line 36, "said members" should be -- the members--.

Column 10, line 6, "tubular" should be --tumbler--.

Column 14, line 4, "cylin cla" should be --cylindrical--

Signed and Sealed this

*Twenty-eighth* Day of *August 1979*

[SEAL]

*Attest:*

*Attesting Officer*

LUTRELLE F. PARKER

*Acting Commissioner of Patents and Trademarks*